US006519966B1

(12) United States Patent
Martin, Sr.

(10) Patent No.: US 6,519,966 B1
(45) Date of Patent: Feb. 18, 2003

(54) AIR CONDITIONING AND HEAT PUMP SYSTEMS

(76) Inventor: Lendell Martin, Sr., P.O. Box 40696, Houston, TX (US) 77240

( * ) Notice: Subject to any disclaimer, the term of this patent is extended or adjusted under 35 U.S.C. 154(b) by 0 days.

(21) Appl. No.: 09/949,960

(22) Filed: Sep. 10, 2001

(51) Int. Cl.[7] ..... F25B 13/00; F25B 39/04; F25D 19/00; F25D 17/06

(52) U.S. Cl. ..... 62/324.1; 62/296; 62/298; 62/412; 62/508

(58) Field of Search ..... 62/324.1, 508, 62/298, 296, 412

(56) References Cited

U.S. PATENT DOCUMENTS

| | | | | |
|---|---|---|---|---|
| 1,819,608 A | | 8/1931 | Lewis | |
| 2,584,442 A | | 2/1952 | Frie | 165/126 |
| 3,596,475 A | | 8/1971 | Berger | 62/285 |
| 4,000,779 A | | 1/1977 | Irwin | 165/111 |
| 4,321,803 A | * | 3/1982 | Smith | 165/125 |
| 4,361,525 A | * | 11/1982 | Leyland | 165/60 |
| 4,470,271 A | * | 9/1984 | Draper et al. | 165/124 |
| 4,542,786 A | | 9/1985 | Anders | 165/144 |
| 4,657,178 A | | 4/1987 | Meckler | 236/13 |
| 4,671,076 A | | 6/1987 | Duren | 62/289 |
| 4,947,930 A | * | 8/1990 | McCrary | 165/240 |
| 5,121,613 A | | 6/1992 | Cox et al. | 62/419 |
| 5,195,332 A | | 3/1993 | Sullivan | 62/291 |
| 5,199,276 A | | 4/1993 | Sullivan | 62/291 |
| 5,207,074 A | | 5/1993 | Cox et al. | 62/285 |
| 5,284,027 A | | 2/1994 | Martin, Sr. | 165/126 X |
| 5,347,980 A | | 9/1994 | Shellenberger | 126/110 |
| 5,379,832 A | * | 1/1995 | Dempsey | 165/110 |
| 5,664,431 A | | 9/1997 | Martin, Sr. | 62/286 |
| 5,967,228 A | | 10/1999 | Bergman et al. | 165/184 |
| 6,253,564 B1 | * | 7/2001 | Yarbrough et al. | 62/238.6 |
| 6,276,443 B1 | | 8/2001 | Martin, Sr. | 165/126 |

FOREIGN PATENT DOCUMENTS

| | | |
|---|---|---|
| GB | 632 003 | 11/1949 |
| GB | 2 048 450 | 12/1980 |
| JP | 58-35343 A | 3/1983 |

OTHER PUBLICATIONS

"A Coil of Quality Allstyle," Allstyle Coil Co., Inc., 1996.
Aspen Manufacturing, Inc. 2000.
Ruud Electric Furnaces, 1988.
ASM Series Low Profile Vertical Coils, Allstyle Coil Co., Inc., 1999.

* cited by examiner

*Primary Examiner*—William C. Doerrler
*Assistant Examiner*—Filip Zec
(74) *Attorney, Agent, or Firm*—Guy McClung

(57) ABSTRACT

An air treatment system having an outer heat exchange coil, an inner heat exchange coil spaced-apart from and encompassed by the outer heat exchange coil, seal structure positioned with respect to both coils so that air pulled through the air treatment system by air movement apparatus may flow through the inner heat exchange coil without flowing through the outer heat exchange coil; and in one aspect, an air treatment system having an outer heat exchange coil; an inner heat exchange coil within the outer heat exchange coil; the inner coil spaced-apart from the outer heat exchange coil; the inner heat exchange coil and the outer heat exchange coil defining an inner chamber therebetween; the inner chamber positioned so that air exhaust apparatus above the inner heat exchange coil moves air into the inner chamber for exhausting therefrom by the air exhaust apparatus; air flowing from outside the outer heat exchange coil, through the outer heat exchange coil, and into the inner chamber; and air flowing from outside the housing between spaced-apart ends of the inner heat exchange coil to within the inner heat exchange coil, through the inner heat exchange coil, and into the inner chamber.

17 Claims, 4 Drawing Sheets

AIR CONDITIONING AND HEAT PUMP SYSTEMS

BACKGROUND OF THE INVENTION

1. Field of the Invention

This invention is directed to air treatment systems, to heat pump systems, coils for them, and methods of their use.

2. Description of Related Art

FIG. 1A and 1B show part of a prior art air conditioning system which has a condenser coil C on a drain pan D. A cover R covers the top of the coil C and has an opening 0 within and/or adjacent which is typically mounted a fan (not shown). A back plate P closes off the open side between the ends of the coil C. The fan pulls air from outside the coil C, through the coil C to cool refrigerant within the coil C.

U.S. Pat. Nos. 5,967,228; 5,664,431; 5,284,027; 5,207,074; 5,199,276; 6,276,443 and the references cited in each of these patents (all said patents and references incorporated fully herein for all purposes) disclose various prior art heat exchange coils and air treatment systems.

There has long been a need for effective and efficient air treatment systems. There has long been a need for a system in which usable coil surface is increased without increasing the size of the housing or cabinet in which a heat exchange coil is positioned. There has long been a need to reduce the noise from such a system.

SUMMARY OF THE PRESENT INVENTION

The present invention, in certain embodiments, discloses an air treatment system (for cooling or heating) that has an outer heat exchange coil, an inner heat exchange coil spaced-apart from and encompassed by the outer heat exchange coil, an either the two coils with ends abutting in sealing contact or seal structure positioned with respect to both coils so that air for heat exchange is pulled through the air treatment system by air movement apparatus flows through the inner heat exchange coil without flowing through the outer heat exchange coil.

In certain embodiments an air treatment system according to the present invention has a housing within which two condenser coils—an inner coil and an outer coil—are mounted spaced-apart from each other. The inner surface of the outer coil and the outer surface of the inner coil define the side boundaries of an inner chamber situated between the two coils. A lower base (a base in an air conditioning system and a drain pan in a heat-pump embodiment of the present invention) underlies and supports the coils; closes off the coils bottoms; and defines the bottom of the inner chamber. An inner coil cover covers a top opening of the inner coil and closes off flow through it. Preferably the inner coil is lower than the outer coil. Thus a fan in fluid communication with the inner chamber for moving air from the inner chamber creates a low pressure within the inner chamber, pulling air from outside the housing through the outer coil from outside the housing and from within the inner coil. This air is exhausted out the top of the housing through an opening in a top housing cover. Air flows through an opening between two ends of the inner coil into the interior of the inner coil (pulled by the exhaust fan). Due to the fact that the top and bottom area between sides of the inner coil are sealed, respectively, by the inner coil cover and part of the lower base, the only passage for air through the inner coil pulled by the exhaust fan is from outside the housing, through the opening between the inner coil ends, through the inner coil (for heat exchange with refrigerant in the inner coil) and then out through the opening in the top cover of the housing. In one aspect the inner and outer coils are condenser coils.

In at least certain embodiments of the present invention, there is more total coil area for a given housing or cabinet and therefore, more efficient cooling (as compared to a single col system). Also, with two spaced-apart coils the space between the coils (as well as the added coil structure) serves as a sound insulator.

What follows are some of, but not all, the objects of this invention. Objects other than the specific objects stated below, additional objects and purposes will be readily apparent to one of skill in this art who has the benefit of this invention's teachings and disclosures. It is, therefore, an object of at least certain preferred embodiments of the present invention to provide new, useful, unique, efficient and nonobvious air conditioning systems and housings and coils for them;

Such systems with an inner coil spaced apart from an outer coil;

Such a system wherein a chamber is defined between the inner and outer coil;

Such a system wherein a fan creates a low pressure in the chamber so that air flows from the inner coil's interior into the low pressure chamber and then out from a housing in which both coils are mounted;

Such systems with seal structure positioned with respect to both coils so that air pulled through the air treatment system by air movement apparatus may flow through the inner heat exchange recoil without flowing through the outer heat exchange coil; and Methods of using such systems.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1A:
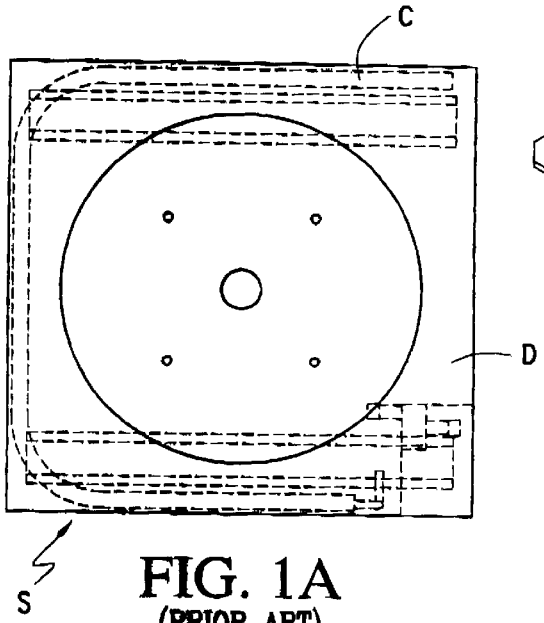
FIG. 1A (PRIOR ART)
FIG. 1A is a top view of a prior art air conditioning system.
Figure 1B:
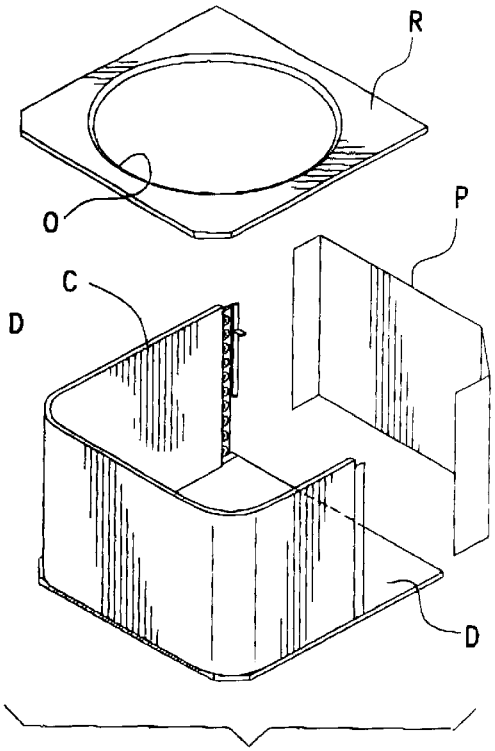
FIG. 1B (PRIOR ART)
FIG. 1B is a perspective exploded view of some of the parts of the system of FIG. 1A.

FIGS. 2A–2E show an air treatment system 10 according to the present invention which has an outer housing 12 with a top cover 14 having a top opening 16 therethrough. A fan 20 (shown schematically in FIG. 2A) is mounted adjacent or near the top opening 16 for exhausting air from within the housing 12 and, as described below, to create a low pressure in an inner chamber 50 between two evaporation coils (30, 40) in the housing 12 so that air flows through each coil for heat transfer with heat transfer fluid flowing through each coil.

Figure 2A:
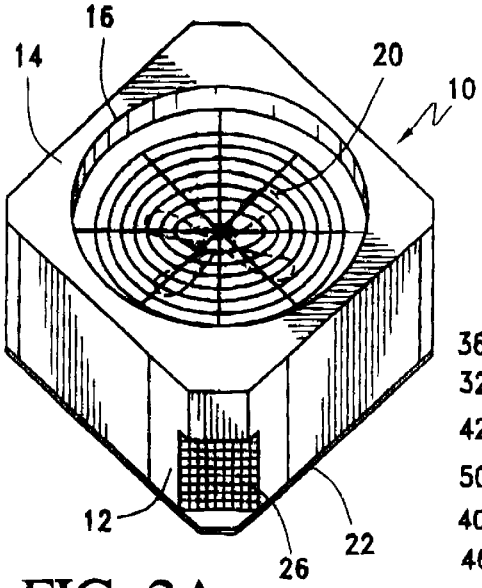
FIG. 2A is a perspective view of an air conditioning system according to the present invention.
Figure 2B:
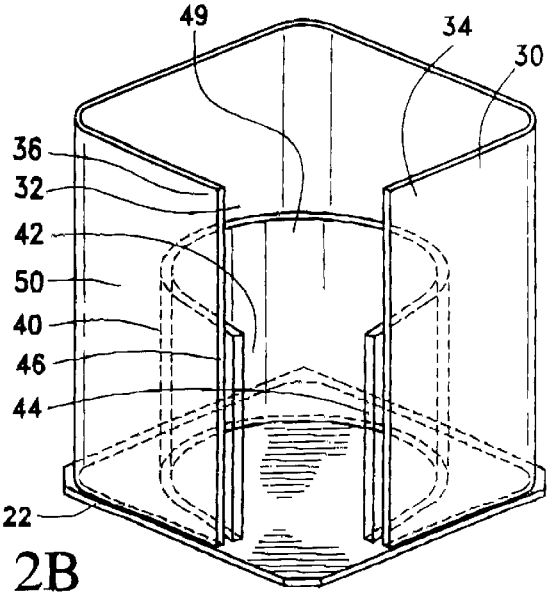
FIG. 2B is a cut-away view of the system of FIG. 2A.
Figure 2C:
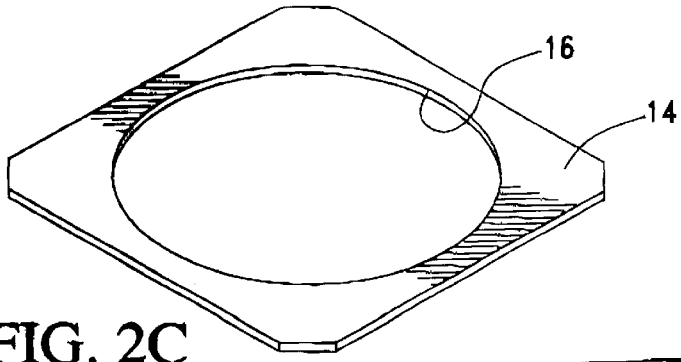
FIG. 2C is a perspective view of a cover of the system of FIG. 2A.
Figure 2E:
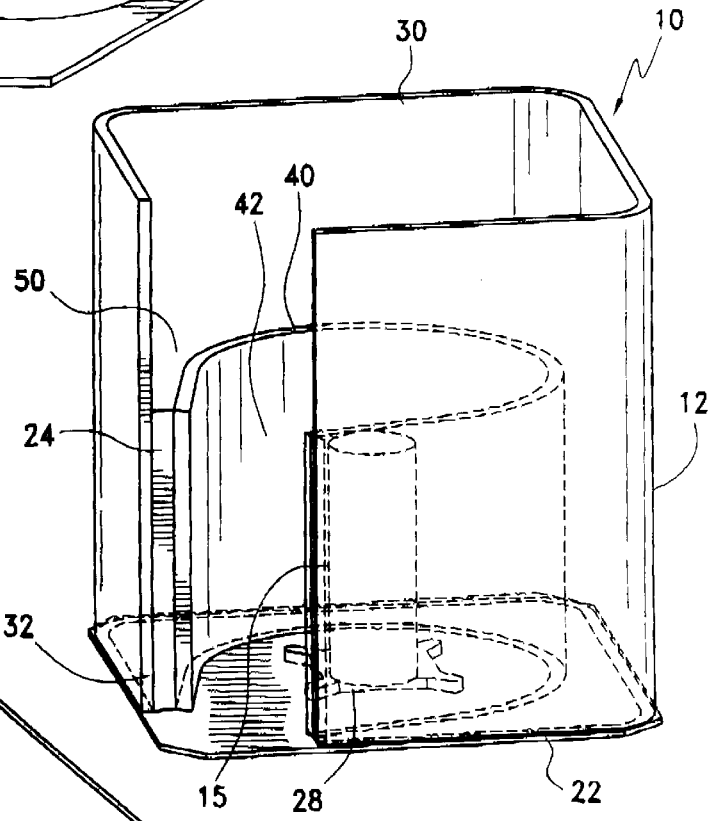
FIGS. 2D and 2E are cut-away perspective views of the system of FIG. 2A.
Figure 2D:
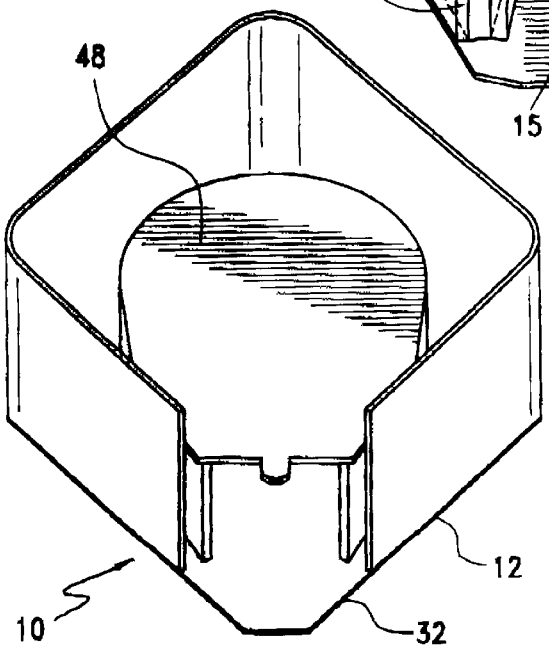
Figure 3:
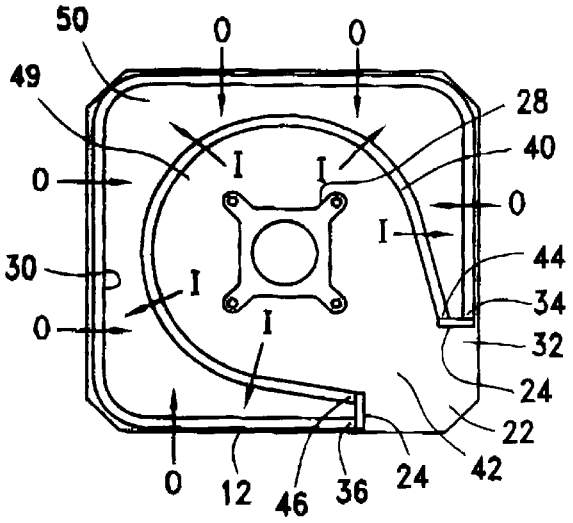
FIG. 3 is a top. view of parts of the system of FIG. 2A.

As shown in FIGS. 2B and 3, an outer coil 30 is mounted on a base 22 (which has a drain pan in a heat pump embodiment of the present invention) and has an opening 32 between its ends 34, 36. The outer coil 30 (and an inner coil 40 described below) may have any desired number of rows and/or intercommunicating slabs of tubing through which refrigerant is pumped by typical pumping apparatus (not shown). Although the coil 30 is shown as generally four-sided (and the coil 40 is shown as generally horseshoe-shaped) it (and the coil 40) may have any desired number of sides of any desired configuration so long as a low pressure chamber is defined between the two coils. In an air concitioning mode both coils are condenser coils.

An inner coil 40 (preferably lower in height than the outer coil 30) is also mounted on the base 22 and has an opening 42 between its ends 44, 46. Optionally a grill 26 may be placed over the opening 32 and/or 42.

Figure 4A:
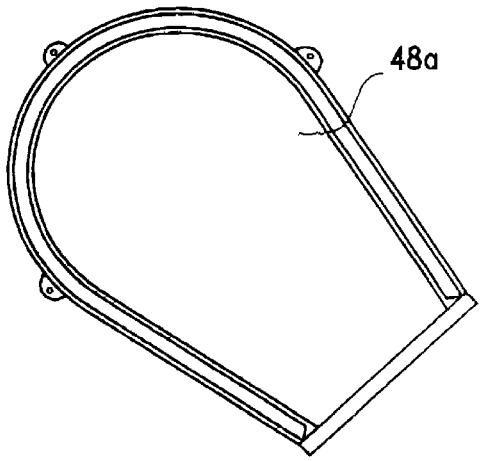
FIG. 4A is a top view of a coil cover of the system of FIG. 2A.
Figure 4B:
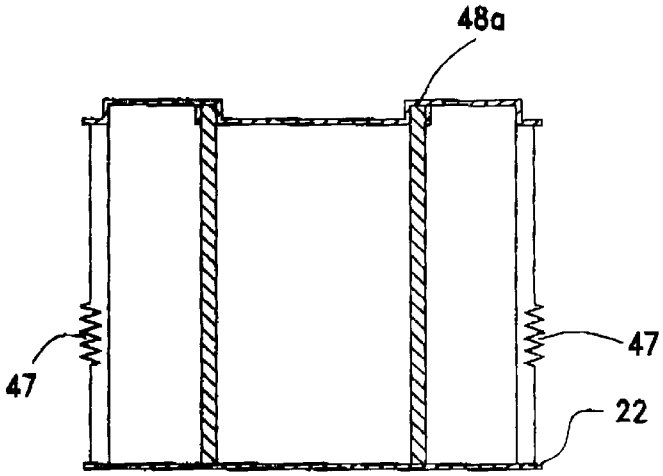
FIG. 4B is a side cross section view of the cover of FIG. 4A.

An inner coil cover 48 (see FIG. 2D), (or 48*a*, see FIGS. 4A, 4B) preferably easily removable, covers and seals off a top opening 49 of the inner coil 40 and seals 24 seal spaces between the coils, ends pulled by the fan 20 through the opening 42 so that air entering into the interior of the inner coil 40 must pass through the coil's rows of tubing before exiting out of the top opening 49. In one aspect the cover 48*a* is held in place by springs 47 connected between the cover 48*a* and part of the system such as the base 22. Alternatively, the cover is held in place with a friction fit between it and the coil 40 and/or with suitable fasteners (e.g. but not limited to screws, nuts and bolts rivets, glue, tape, etc.). A seal may be used around the cover/coil interface. The cover 48*a* illustrates that the shape of the coil 40, as viewed from above, may be any desired shape.

A compressor 15 (see FIG. 2E) is mounted on a base plate 28 within the inner coil 40.

In operation, in certain aspects, a fan, (e.g., the fan 20) e g. a 1/15 to ½ horsepower fan rotating at 625 to 1125 rpm's and moving 500 to 4000 cfm (e.g. the fan 20, FIG. 2A) creates a low pressure in the inner chamber and thus pulls air through both coils, with air flow through the outer coil 30 from outside the outer coil 30 (outside the system) to its interior (see arrows O in FIG. 3) and with air flow from outside the system housing to and then through the inner coil 40's opening 42, from within its interior, and then to the exterior of the inner coil 40, i.e., into the inner chamber 50 (see the arrows I in FIG. 3). This air from both coils 30, 40 flows into the inner chamber 50 and the fan 20 exhausts it from the inner chamber 50 and out through the top opening 16 of the top cover 14.

Optionally the seals 24 are deleted and the coils' ends sealingly abut each other.

Figure 5:
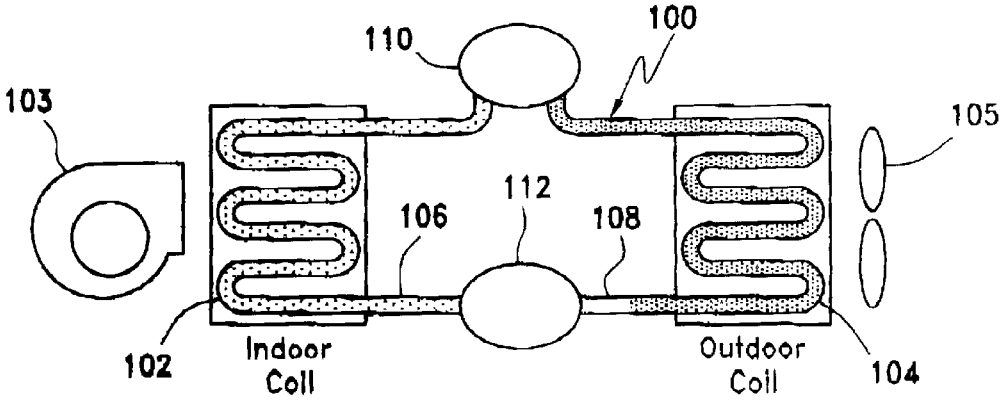
FIG. 5 is a schematic view of systems according to the present invention.

FIG. 5 shows a system 100 according to the present invention which may be either an air conditioning system for cooling air in a building, room or enclosure; or a heat pump system for heating a building, etc. The system 100 has an indoor coil system 102 with fan or blower 103; an outdoor coil system 104 with fan 105; flow lines 106, 108; and valve systems 110, 112. The outdoor coil system 104 may be any coil system or combination thereof disclosed herein according to the present invention, including, but not limited to, a system like the system 10 disclosed above. In a heat pump embodiment, the valve systems 110, 112 include well-known reversing valve(s), check valve(s), restrictor(s) etc. so that the system 100 is operable as a heat pump.

In operation as a cooling air conditioner, the coil system 104 has condenser coils and the coil system 102 has one or more evaporator coils.

Figure 6A:
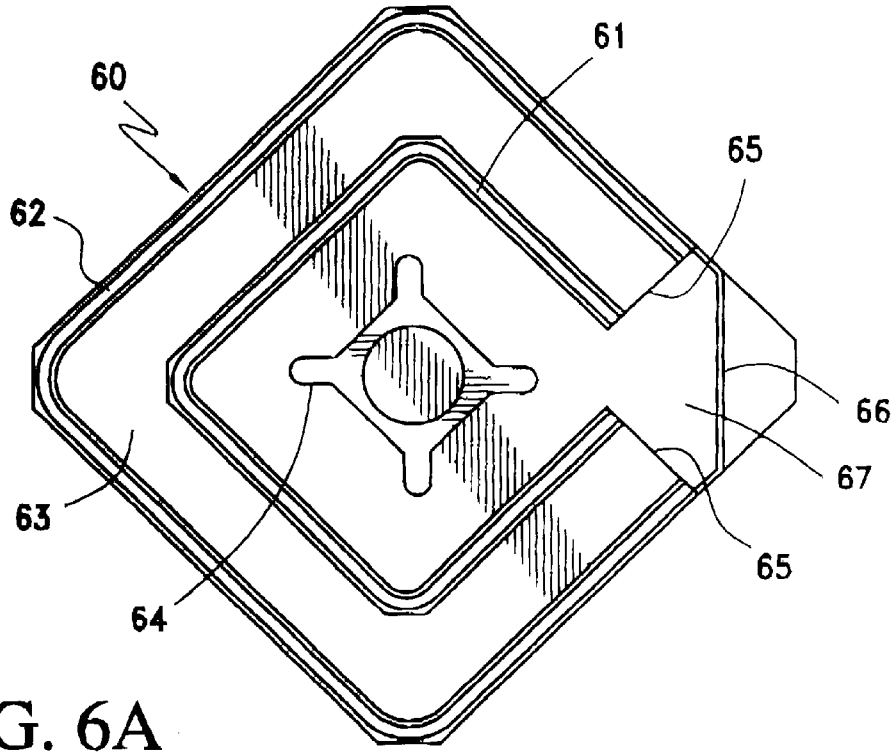
FIGS. 6A and 6B are top views of systems according to the present invention.
Figure 6B:
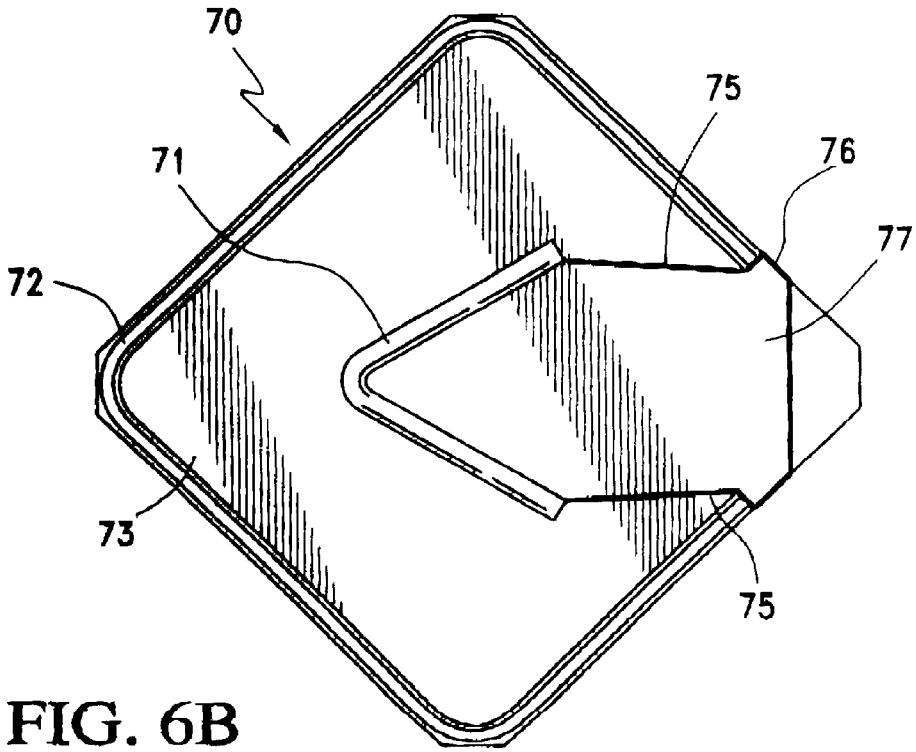

FIGS. 6A and 6B show alternative shapes (as viewed from above) for the inner coil of a system according to the present invention. FIG. 6A shows a system 60 according to the present invention with an inner coil 61 and an outer coil 62 on a base 63 (like the base or pan 22, FIG. 2A) with a compressor base plate 64 (like the plate 28, FIG. 3). A housing, fan, cover, and grill as in the system 10 may be used with the system 60. Seals 65 (like the seals 24, FIG. 3) seal spaces between coil ends. An optional grill 66 (like grill 26, FIG. 2A) may be sued across an opening 67. FIG. 6B shows a system 70 according to the present invention with an inner coil 71 and an outer coil 72 on a base 73 (like the base or pan 22, FIG. 2A). A housing, compressor base plate, fan, cover, and grill as in the system 10 or 60 may be used with the system 70. Seals 75 (like the seals 24 or 65) seal spaces between coil ends. A grill 76 (like grill 26, FIG. 2A) is across an opening 77.

The present invention, therefore, in some, but in not necessarily all embodiments, provides a method for conditioning air, the method including using an air conditioning system according to the present invention.

The present invention, therefore, in some, but in not necessarily all embodiments, provides a air treatment system with an outer heat exchange coil, an inner heat exchange coil spaced-apart from and encompassed by the outer heat exchange coil, and seal structure positioned with respect to both coils so that air pulled through the air treatment system by air movement apparatus may flow through the inner heat exchange coil without flowing through the outer heat exchange coil.

The present invention, therefore, in some, but in not necessarily all embodiments, provides an air treatment system with an outer heat exchange coil; an inner heat exchange coil within the outer heat exchange coil; the inner coil spaced-apart from the outer heat exchange coil; the inner heat exchange coil and the outer heat exchange coil defining an inner chamber therebetween; the inner chamber positioned so that air exhaust apparatus above the inner heat exchange coil moves air into the inner chamber for exhausting therefrom by the air exhaust apparatus; air flowing from outside the outer heat exchange coil, through the outer heat exchange coil, and into the inner chamber; and air flowing from outside the housing between spaced-apart ends of the inner heat exchange coil to within the inner heat exchange coil, through the inner heat exchange coil, and into the inner chamber.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The invention claimed herein is not obvious in accordance with 35 U.S.C. § 103 and satisfies the conditions for patentability in § 103. This specification and the claims that follow are in accordance with all of the requirements of 35 U.S.C. § 112. The inventor may rely on the Doctrine of Equivalents to determine and assess the scope of the invention and of the claims that follow as they may pertain to apparatus not materially departing from, but outside of, the literal scope of the invention as set forth in the following claims.

What is claimed is:

1. An air treatment system comprising an outer heat exchange coil;

an inner heat exchange coil within the outer heat exchange coil; the inner coil spaced-apart from the outer heat exchange coil;

the inner heat exchange coil and the outer heat exchange coil defining an inner chamber therebetween;

the inner chamber positioned so that air exhaust apparatus above the inner heat exchange coil moves air into the inner chamber for exhausting therefrom by the air exhaust apparatus; air flowing from outside the outer heat exchange coil, through the outer heat exchange coil, and into the inner chamber; and air flowing from outside the housing between spaced-apart ends of the inner heat exchange coil to within the inner heat exchange coil, through the inner heat exchange coil, and into the inner chamber.

2. The air treatment system of claim 1 further comprising compressor apparatus encompassed by the inner heat exchange coil, the compressor apparatus for compressing heat exchange fluid flowing through the coils.

3. The air treatment system of claim 1 further comprising the inner heat exchange coil having two spaced apart inner coil ends comprising a first inner coil end and a second inner coil end, the outer heat exchange coil having two spaced apart outer ends comprising a first outer end and a second outer end, the first inner end in sealing contact with the first outer end, and the second inner end in sealing contact with the second outer end.

4. The air treatment system of claim 1 further comprising the inner heat exchange coil having two spaced apart inner coil ends comprising a first inner coil end and a second inner coil end, the outer heat exchange coil having two spaced apart outer ends comprising a first outer end and a second outer end, the first inner end spaced apart from the first outer end with a first end space therebetween, the second inner end spaced apart form the second outer end with a second end space therebetween, first sealing structure sealing the first end space so that air is not flowable through the first end space into the inner chamber, and second sealing structure sealing the second end space so that air is not flowable through the second end space into the inner chamber.

5. The air treatment system of claim 1 further comprising the inner heat exchange coil having a top opening defined by sidewalls of the heat exchange coil, and a cover over the top opening closing the top opening off to air flow.

6. The air treatment system of claim 5 wherein the cover is releasably secured over the top opening of the inner heat exchange coil.

7. The air treatment system of claim 1 further comprising the inner heat exchange coil generally horseshoe-shaped as viewed from above.

8. The air treatment system of claim 1 further comprising the inner heat exchange coil generally V-shaped as viewed from above.

9. The air treatment system of claim 1 further comprising the inner heat exchange coil generally rectangularly-shaped as viewed from above.

10. The air treatment system of claims 1 further comprising the outer heat exchange coil generally rectangularly-shaped as viewed from above.

11. The air treatment system of claim 2 wherein the compressor apparatus emits sound during operation and the inner heat exchange coil muffles said sound.

12. The air treatment system of claim 1 wherein the inner heat exchange coil is lower than the outer heat exchange coil.

13. A method for treating air, the method comprising flowing air to an air treatment system, the air treatment system comprising an outer heat exchange coil, an inner heat exchange coil spaced-apart from and encompassed by the outer heat exchange coil, seal structure positioned with respect to both coils so that air pulled through the air treatment system by air movement apparatus may flow through the inner heat exchange coil without flowing through the outer heat exchange coil, flowing the air through the air treatment system, and wherein the inner heat exchange coil and the outer heat exchange coil define an inner chamber therebetween; the inner chamber positioned so that air exhaust apparatus above the inner heat exchange coil moves air into the inner chamber for exhausting therefrom by the air exhaust apparatus; air flowing from outside the outer heat exchange coil, through the outer heat exchange coil, and into the inner chamber; and air flowing from outside the housing between spaced-apart ends of the inner heat exchange coil to within the inner heat exchange coil, through the inner heat exchange coil, and into the inner chamber, the method further comprising compressing heat, exchange fluid flowing through the coils.

14. The method of claim 13 wherein the air treatment system is an air conditioning system.

15. The method of claim 13 wherein the air treatment system is a heat pump system.

16. A method for muffling the sound of an operational compressor in an air treatment system, the method comprising positioning the compressor within two spaced-apart heat exchange coils, wherein the air treatment system further comprises the two-spaced apart heat exchange coils including an inner heat exchange coil and an outer heat exchange coil, the inner heat exchange coil having two spaced apart inner coil ends comprising a first inner coil end and a second inner coil end, the outer heat exchange coil having two spaced apart outer ends comprising a first outer end and a second outer end, the first inner end in sealing contact with the first outer end, and the second inner end in sealing contact with the second outer end.

17. The method of claim 16 wherein the air treatment system includes seal structure positioned with respect to the two spaced-apart coils so that air pulled through the air treatment system by air movement apparatus may flow through the inner heat exchange coil without flowing through the outer heat exchange coil.

* * * * *